US007568984B2

(12) United States Patent
Matsunaga

(10) Patent No.: US 7,568,984 B2
(45) Date of Patent: Aug. 4, 2009

(54) HOLLOW GOLF CLUB HEAD

(75) Inventor: Hideo Matsunaga, Saitama (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 221 days.

(21) Appl. No.: 11/508,211

(22) Filed: Aug. 23, 2006

(65) Prior Publication Data

US 2007/0049413 A1 Mar. 1, 2007

(30) Foreign Application Priority Data

Aug. 23, 2005 (JP) ..... 2005-241747
Apr. 14, 2006 (JP) ..... 2006-112343

(51) Int. Cl.
*A63B 53/04* (2006.01)

(52) U.S. Cl. ..... 473/332; 473/345; 473/349

(58) Field of Classification Search ..... 473/324–350, 473/287–292
See application file for complete search history.

(56) References Cited

U.S. PATENT DOCUMENTS

| | | | | | |
|---|---|---|---|---|---|
| 777,400 | A * | 12/1904 | Clark | 473/329 |
| 4,021,047 | A * | 5/1977 | Mader | 473/345 |
| 4,139,196 | A | 2/1979 | Riley | |
| 4,432,549 | A * | 2/1984 | Zebelean | 473/346 |
| 5,180,166 | A | 1/1993 | Schmidt et al. | |
| 5,205,560 | A | 4/1993 | Hoshi et al. | |
| 5,255,913 | A | 10/1993 | Tsuchida | |
| 5,316,298 | A * | 5/1994 | Hutin et al. | 473/332 |
| 5,328,176 | A * | 7/1994 | Lo | 473/342 |
| 5,346,217 | A | 9/1994 | Tsuchiya et al. | |
| 5,351,958 | A | 10/1994 | Helmstetter | |
| 5,411,255 | A * | 5/1995 | Kurashima et al. | 473/332 |
| 5,511,786 | A | 4/1996 | Antonious | |
| 6,074,310 | A | 6/2000 | Ota | |
| 6,348,013 | B1 | 2/2002 | Kosmatka | |
| 6,783,465 | B2 * | 8/2004 | Matsunaga | 473/329 |
| 6,783,466 | B2 | 8/2004 | Seki et al. | |
| 6,849,003 | B2 * | 2/2005 | Kumamoto | 473/305 |
| 6,880,222 | B2 * | 4/2005 | Matsunaga | 29/428 |
| 6,945,876 | B2 | 9/2005 | Nakahara et al. | |
| 7,214,142 | B2 * | 5/2007 | Meyer et al. | 473/332 |
| 7,250,007 | B2 * | 7/2007 | Lu | 473/329 |

(Continued)

FOREIGN PATENT DOCUMENTS

GB 2 270 630 A 3/1994

(Continued)

*Primary Examiner*—Sebastiano Passaniti
(74) *Attorney, Agent, or Firm*—Sughrue Mion, PLLC

(57) ABSTRACT

A hollow golf club head is provided that includes a face portion, a sole portion extending backward from a lower portion of the face portion to form a bottom portion of the golf club head, a crown portion extending backward from an upper portion of the face portion to form an upper portion of the golf club head, and a vibration absorbing layer in a film form composed of an elastic body on an inner surface of the crown portion. The sole portion and the crown portion are configured such that a ratio of a rigidity of the sole portion to a rigidity of the crown portion is 1: 0.1 to 0.8, and the vibration absorbing layer has a ring shape covering an outer peripheral portion of the crown portion. The launch angle of a ball is increased so that the traveling distance of a shot can be increased.

12 Claims, 10 Drawing Sheets

U.S. PATENT DOCUMENTS

| | | | | |
|---|---|---|---|---|
| 2003/0083151 | A1 | 5/2003 | Nakahara et al. | |
| 2003/0125127 | A1 | 7/2003 | Nakahara et al. | |
| 2003/0134692 | A1 | 7/2003 | Nakahara et al. | |
| 2004/0078955 | A1 | 4/2004 | Matsunaga | |
| 2004/0116207 | A1 | 6/2004 | De Shiell et al. | |
| 2006/0063608 | A1* | 3/2006 | Mori et al. | 473/345 |
| 2007/0060414 | A1* | 3/2007 | Breier et al. | 473/350 |

FOREIGN PATENT DOCUMENTS

| | | | |
|---|---|---|---|
| JP | 07-284546 | A | 10/1995 |
| JP | 2000-317018 | A | 11/2000 |
| JP | 2001-346918 | A | 12/2001 |
| JP | 2003-052866 | A | 2/2003 |
| JP | 2003-079768 | A | 3/2003 |
| JP | 2003-088601 | A | 3/2003 |
| JP | 2004-065660 | A | 3/2004 |
| JP | 2004-167127 | A | 6/2004 |
| JP | 2004-180759 | A | 7/2004 |
| JP | 2004-222792 | A | 8/2004 |
| JP | 2004-229820 | A | 8/2004 |
| JP | 2005-137788 | A | 6/2005 |

* cited by examiner

HOLLOW GOLF CLUB HEAD

BACKGROUND OF THE INVENTION

1. Field of the Invention

The present invention relates to a hollow golf club head in which the launch angle of a ball is increased so that the traveling distance of a shot can be increased.

2. Description of the Related Art

In recent years, hollow golf club heads have been proposed in which not only their face portion but also their crown portion deform elastically when hitting a ball, to increase the launch angle, so as to increase the traveling distance of a shot.

Japanese Patent Laid-Open No. 2003-52866 discloses a hollow golf club head made of metal and having a face portion, sole portion, side portion, crown portion, and hosel portion. This golf club head is formed of a front part and back part. The front part is made of a cast product in which at least the main portion of the crown portion and the face portion are integrally formed. In the back part, portions other than the front part are integrally formed. The front and back parts are joined to each other.

Japanese Patent Laid-Open No. 2003-79768 discloses a hollow golf club head made of metal and having at least a face portion, sole portion, side portion, and crown portion. A metal material that forms the crown portion has the lowest modulus of longitudinal elasticity.

Japanese Patent Laid-Open No. 2003-88601 discloses a hollow golf club head made of metal and having a face portion, sole portion, toe-side side portion, heel-side side portion, back-side side portion, crown portion, and hosel portion. The crown portion has a plurality of grooves extending from the toe-side side portion to the heel-side side portion.

Japanese Patent Laid-Open No. 2005-137788 discloses a hollow golf club head having a face portion with a face surface to hit the ball, and a head main body portion continuous to the rear surface of the face portion and extending to the back of the head. The head main body portion includes a crown portion, sole portion, and side portion which respectively form a head upper portion, head bottom portion, and head side portion. The crown portion includes a crown front portion and crown rear portion. The crown front portion forms a front region extending from the rear surface of the face portion to a position at a distance 0.15 times a crown depth length Lc. The crown rear portion forms a rear region extending from the rear surface of the face portion to a position at a distance 0.30 times to 1.0 time the crown depth length Lc. The crown front portion has a rigidity lower than that of the crown rear portion.

The conventional golf club heads described above still have room for improvement in terms of increasing the launch angle of a ball.

SUMMARY OF THE INVENTION

The present invention has been made in order to overcome the deficits of prior art.

According to the aspects of the present invention, it is provided a hollow golf club head having a sole portion and a crown portion, wherein a ratio of a rigidity of the sole portion to that of the crown portion is 1:0.1 to 0.8.

The hollow golf club head according to the aspects of the invention can increase the launch angle of a ball so that the traveling distance of a shot can be further increased.

According to the aspects of the present invention, the rigidity refers to a value calculated by the following equation (x):

$$\text{rigidity (unit: MPa}\cdot\text{mm}^4)=E\times I \quad \text{(x)}$$

where E: Young's modulus (unit: MPa)

I: moment of inertia of area (unit: $mm^4$)

Young's modulus E depends on a material constituting the golf club head, and the moment I of inertia of area depends on thickness of the constituent of the golf club head. If the thickness of the constituent is the same, the ratio of rigidity is determined by the ratio of magnitudes of Young's modulus E. If the material of the constituent is the same, the ratio of rigidity is determined by the value of the cube of the ratio of the thicknesses.

According to the aspects of the present invention, the sole portion of the golf club head refers to a portion extending backward from the lower portion of a face portion of the golf club head to form the bottom portion of the head. The crown portion of the golf club head refers to a portion extending backward from the upper portion of the face portion to form the upper portion of the head. A side portion of the golf club head refers to a portion extending backward from between the upper and lower portions of the face portion to form a head side portion. The side portion includes a toe-side side portion, heel-side side portion, and back-side side portion.

According to the aspects of the present invention, preferable value of the ratio of the rigidity of the sole portion to that of the crown portion is 1:0.2 to 0.6.

According to the aspects of the present invention, in order to increase the launch angle of a ball, a ratio of the rigidity of the sole portion to that of the side portion is preferably 1:0.1 to 0.8. A more preferable value of the ratio of the rigidity of the sole portion to that of the side portion is 1:0.2 to 0.6.

According to the aspects of the present invention, a ratio of an average thickness of the sole portion to that of the crown portion is preferably 1:0.3 to 0.8. A more preferable value of the ratio of the average thickness of the sole portion to that of the crown portion is 1:0.5 to 0.7.

According to the aspects of the present invention, preferably, the average thickness of the sole portion is 0.9 mm to 2.0 mm, the average thickness of the crown portion is 0.5 mm to 1.2 mm.

According to the aspects of the present invention, a ratio of Young's modulus of a material of the sole portion to that of a material of the crown portion is preferably 1:0.3 to 0.9. A more preferable value of the ratio of Young's modulus of the material of the sole portion to that of the material of the crown portion is 1:0.5 to 0.8.

In the present invention, preferably, Young's modulus (E) of a material of the sole portion is 105,000 MPa to 120,000 MPa, and Young's modulus of a material of the crown portion is 70,000 MPa to 95,000 MPa.

According to the aspects of the present invention, a vibration absorbing layer in a film form composed of an elastic body is preferably provided on an inner surface of the crown portion. Namely, the crown portion reduced in rigidity has elastic deformation larger than the crown portion of an ordinary golf club head, and vibration remains after hitting a ball. If a material of the crown portion is changed, excellent ball hitting feeling cannot be sometimes obtained since the Young's modulus (longitudinal modulus) of the respective materials differ. Thus, by providing the vibration absorbing layer in the film form composed of an elastic body at the crown portion with low rigidity, vibration of the crown portion is suppressed, and ball hitting feeling is improved.

The kind of the elastic body which forms the vibration absorbing layer is not necessarily limited, but a resin having rubber elasticity at a room temperature, elastomer, rubber or foams thereof is preferable, and these elastic bodies into which a short fiber material (fiber) and an extender pigment (calcium carbonate, crystal stone, etc.) are mixed is especially preferable. An especially preferable material to form the vibration absorbing layer is a viscoelastic body having both viscosity and elasticity. As a viscoelastic body, IIR (butyl rubber, Isobutene-Isoprene Rubber), butylbromide rubber, CSM (Chloro-Sulfonated polyethylene Rubber: Hypalon rubber), NBR (Acrylonitrile Butadiene Rubber), NR (Natural Rubber), SR (Silicon Rubber), styrene rubber and the like are cited, and butyl rubber, butylbromide rubber, CMS rubber and NBR are especially preferable. Rubber made by mixing natural rubber and butyl rubber may be used.

As the above described viscoelastic body, the one having loss coefficients (tan δ) of not less than 0.3 in the range of −40° C. to −10° C., or having a peak value of not less than 0.5 in the range of −40° C. to −10° C. is prefarrable. The ratio (G"/G') of the storage shear modulus (G') and the loss shear modulus (G") is called a loss tangent (loss coefficients), is expressed by tan δ, and shows how much energy a material absorbs (converts into heat) at a time of deformation of the material. Measurement of the loss coefficients can be performed with a dynamic viscoelasticity measuring device. As the value of tan δ is larger, the material absorbs more energy, the impact resilience rate becomes smaller in the impact buffer test, and the resonance multiplying factor becomes lower in the vibration test.

The shape and thickness of the vibration absorbing layer are not limited, but as the shape, a plate shape covering the substantially entire inner surface of the crown portion, a ring shape covering an outer peripheral portion of the crown portion or the like can be adopted, and the shape is not limited to them. It is suitable to set the thickness at 0.1 to 1 mm, especially at 0.3 to 0.8 mm.

A method of forming the vibration absorbing layer is not limited, and the vibration absorbing layer can be formed by bonding the plate-shaped elastic body onto the inner surface of the crown portion with an adhesive, or coating the elastic body material on the inner surface of the crown portion, for example. In the case of coating, in order to make the vibration absorbing layer thick, a large amount of short fiber material (fiber) and extender pigment are kneaded into a two-liquids type urethane resin, an alkyd resin, a vinyl/acrylic resin, rubber emulsion or the like.

The manufacturing method for the golf club head according to the aspects of the present invention is not particularly limited. For example, the golf club head can be manufactured by closing a face opening of a head main body with a face member. In this case, the material and molding method for the head main body are not particularly limited. Titanium, a titanium alloy, stainless steel, an amorphous material, or the like can be used as the material. The head main body can be monolithically molded by casting. The material and molding method for the face member are also not particularly limited. As with the material, titanium, a titanium alloy, stainless steel, an amorphous material, or the like can be used. As the molding method, forging, press forming of pressing a plate material, or die casting is preferable.

The method for joining the face member to the head main body is not particularly limited, but plasma welding, laser welding, or electron beam welding is suitable in terms of finishing the joined portion with a good appearance and improving the weight accuracy of the golf club head. In this case, plasma welding can be employed in which a welding target material is dissolved by a high-temperature energy generated by plasma arc and solidified again to weld. As for laser welding, known laser welding which uses a gas laser such as CO laser or $CO_2$ laser, or a solid laser such as a YAG laser can be employed. As for electron beam welding, known electron beam welding which uses an electron beam having an appropriate output can be employed.

When the above described vibration absorbing layer is provided on the inner surface of the crown portion, the crown portion with the vibration absorbing layer formed on the inner surface can be separately manufactured, and the crown portion and the head main body, or the head main body and the face member can be joined. When the crown portion and the head main body, or the head main body and the face member are joined by welding, it is preferable to set the distance between the welding position and the vibration absorbing layer at not less than 10 mm. This is because there is the fear of the elastic body melting with the heat by welding. When an extended portion for disposing the crown portion are provided at the side portion and the face portion, the extended portion and the crown portion are directly bonded to each other by an adhesive, or the extended portion and the crown portion may be bonded in the state in which the vibration absorbing layer is sandwiched therebetween. In this case, the crown portion, the head main body, the face member and the like are bonded after coating of the outer surface is performed in advance. This is because when the crown portion is bonded by welding, a crack does not occur to the coating film at the time of hitting a ball, but when an adhesive is used, a crack easily occurs to the coating film at the time of hitting a ball.

The golf club head according to the aspects of the present invention can be formed as, e.g., a wood type golf club head or utility type golf club head having a hollow portion. More specifically, the golf club head according to the aspects of the present invention can be formed as a hollow golf club head having the following head volume and loft angle:

(a) a hollow golf club head having a head volume of 250 $cm^3$ to 470 $cm^3$ and a loft angle in a range from 7 to 15 degrees, (b) a hollow golf club head having a head volume of 150 $cm^3$ to 250 $cm^3$ and a loft angle in a range from 12 to 28 degrees, and (c) a hollow golf club head having a head volume of 70 $cm^3$ to 150 $cm^3$ and a loft angle in a range from 15 to 32 degrees.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate an embodiment of the invention and, together with the description, serve to explain the principles of the invention.

DESCRIPTION OF THE EMBODIMENTS

A preferred embodiment of the present invention will now be described in detail in accordance with the accompanying drawings.

Figure 1:
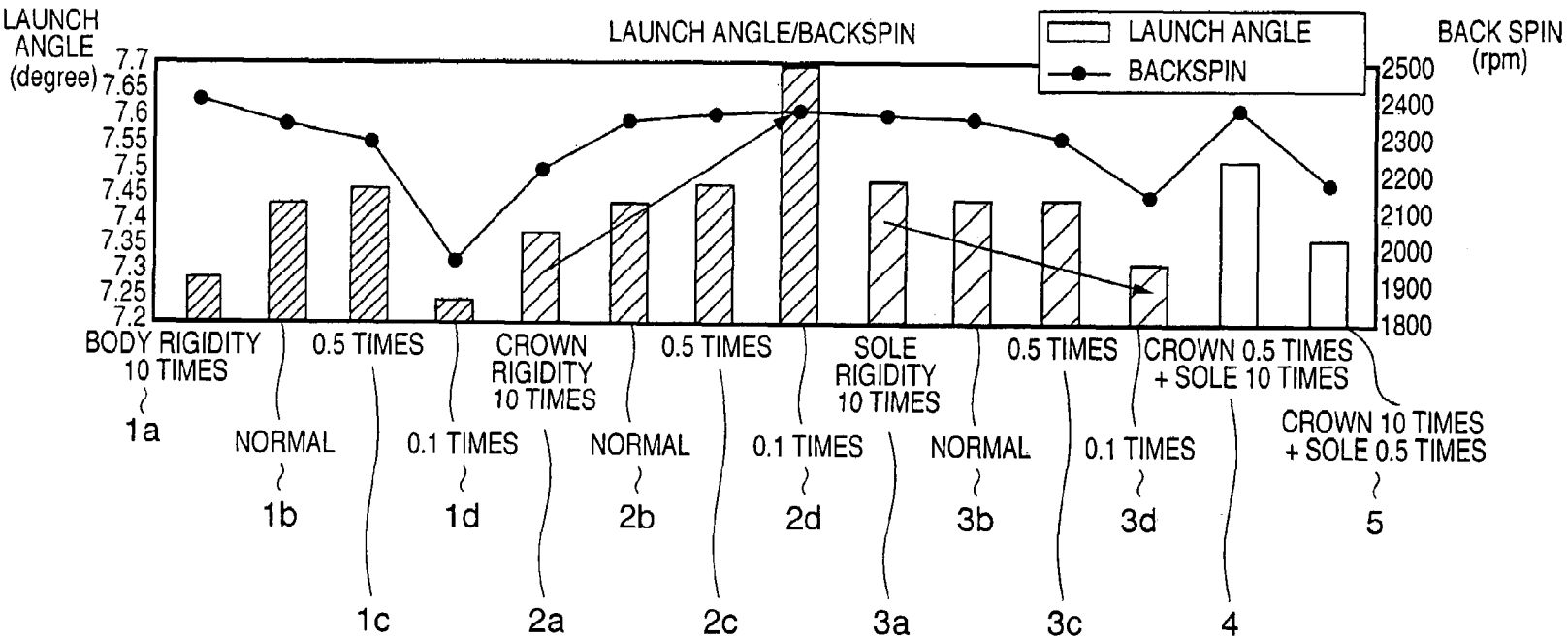
FIG. 1 is a graph showing variations of the launch angle of a ball and the backspin amount when body rigidity, crown rigidity, and sole rigidity of a golf club head are changed.

First, an experiment that demonstrates the effect of the present invention will be described. FIG. 1 is a graph showing variations of the launch angle of a ball angle and the backspin amount when the rigidity of the entire golf club head (body rigidity), the rigidity of the crown portion (crown rigidity), and the rigidity of the sole portion (sole rigidity) are changed. Referring to FIG. 1, sample number 1*a* indicates a golf club head with body rigidity 10 times the normal value. Sample number 1*b* indicates a golf club head with normal body rigidity (1 time). Sample number 1*c* indicates a golf club head with body rigidity 0.5 times the normal value. Sample number 1*d* indicates a golf club head with body rigidity 0.1 times the normal value. Sample number 2*a* indicates a golf club head with crown rigidity 10 times the normal value. Sample number 2*b* indicates a golf club head with normal crown rigidity (1 time). Sample number 2*c* indicates a golf club head with crown rigidity 0.5 times the normal value. Sample number 2*d* indicates a golf club head with crown rigidity 0.1 times the normal value. Sample number 3*a* indicates a golf club head with sole rigidity 10 times the normal value. Sample number 3*b* indicates a golf club head with normal sole rigidity (1 time). Sample number 3*c* indicates a golf club head with sole rigidity 0.5 times the normal value. Sample number 3*d* indicates a golf club head with sole rigidity 0.1 times the normal value. Sample number 4 indicates a golf club head with crown rigidity 0.5 times the normal value and sole rigidity 10 times the normal value. Sample number 5 indicates a golf club head with crown rigidity 10 times the normal value and sole rigidity 0.5 times the normal value. The results of FIG. 1 show that when the rigidity of the crown portion is decreased and that of the sole portion is increased, the launch angle of a ball increases.

Figure 2:
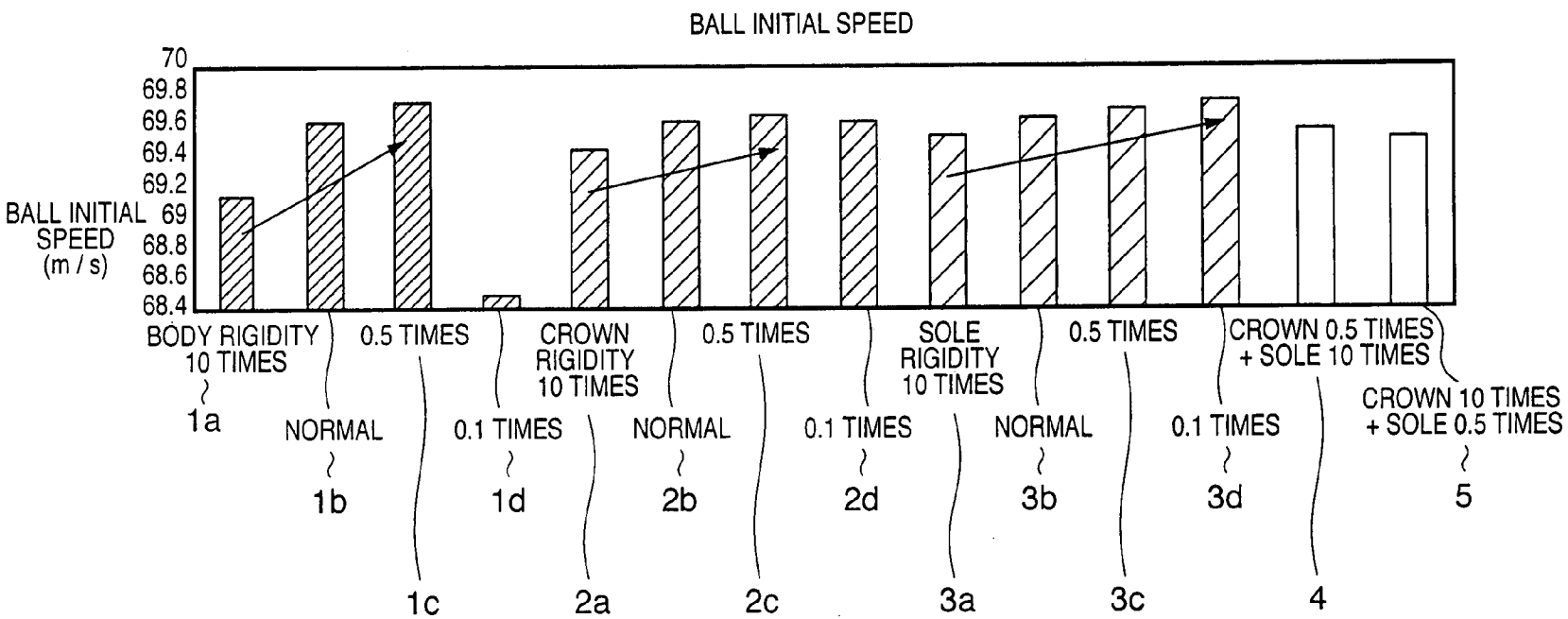
FIG. 2 is a graph showing variations of the initial speed of a ball when the body rigidity, crown rigidity, and sole rigidity of the golf club head are changed.

FIG. 2 is a graph showing variations of the initial speed of a ball when body rigidity, crown rigidity, and sole rigidity are changed. FIG. 2 is used as a comparison with the present invention in which the launch angle of a ball is increased. Referring to FIG. 2, sample numbers 1*a* to 1*d*, 2*a* to 2*d*, 3*a* to 3*d*, 4, and 5 indicate the same golf club heads as those of FIG. 1. The results of FIG. 2 show that when the rigidities of both the crown portion and sole portion are decreased, the initial speed of a ball increases.

Figure 3:
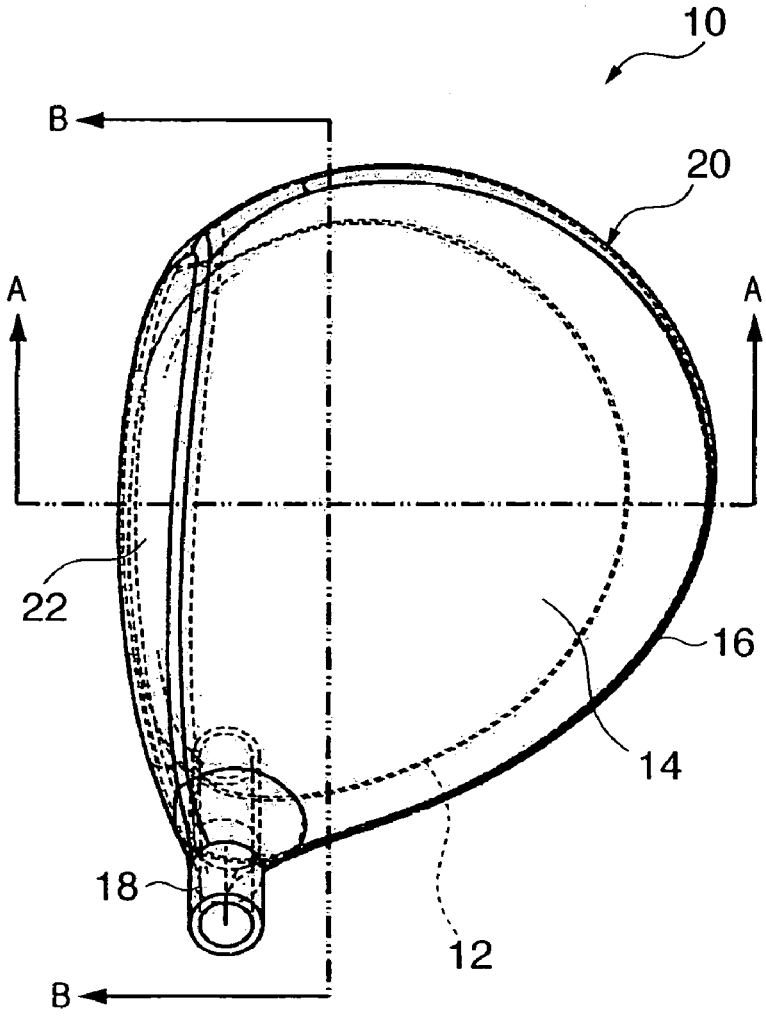
FIG. 3 is a plan view showing a golf club head according to an embodiment of the present invention.
Figure 4:
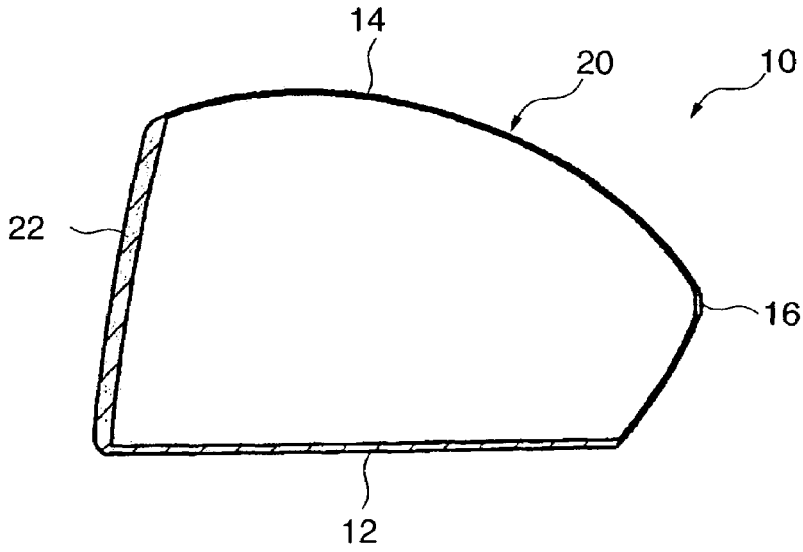
FIG. 4 is a sectional view taken along the line A-A of FIG. 3.
Figure 5:
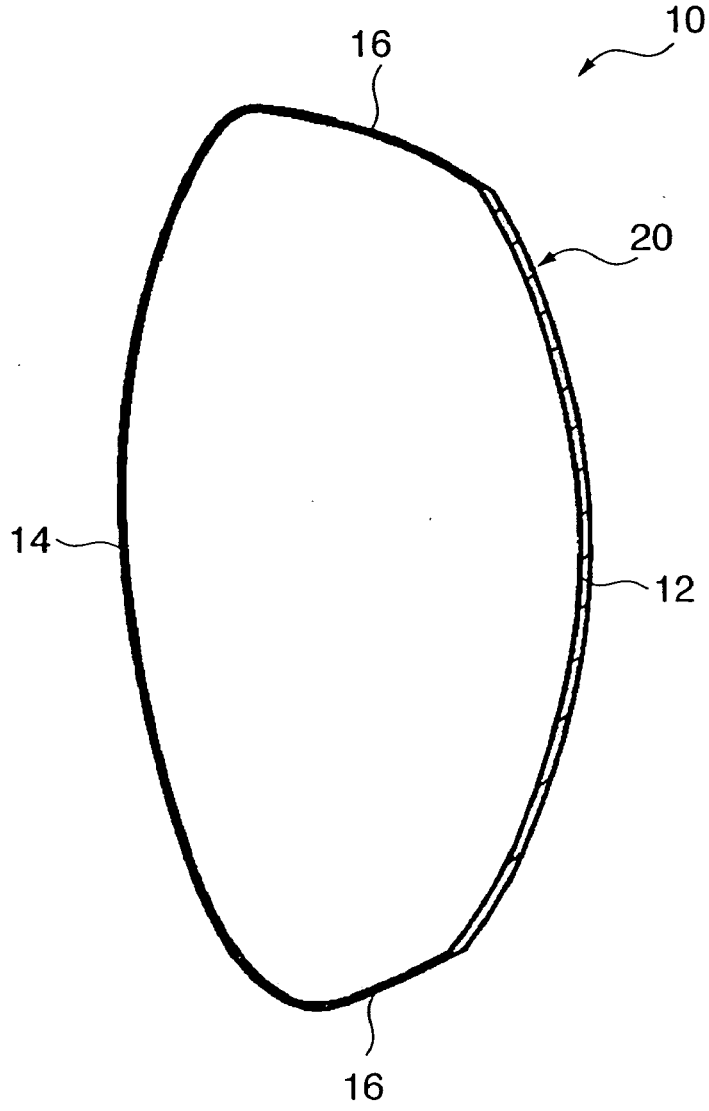
FIG. 5 is a sectional view taken along the line B-B of FIG. 3.

FIG. 3 is a plan view showing a golf club head according to an embodiment of the present invention, FIG. 4 is a sectional view taken along the line A-A of FIG. 3, and FIG. 5 is a sectional view taken along the line B-B of FIG. 3.

A golf club head 10 according to this embodiment is obtained by fixing a face member 22 to the face opening of a head main body 20 having a sole portion 12, crown portion 14, side portion 16, and hosel portion 18 by plasma welding. The material of the head main body 20 is 6-4Ti (titanium alloy, Ti-6Al-4V) and the material of the face member 22 is SP700 (titanium alloy, Ti-4. 5Al-3V-2Fe-2Mo). The golf club head of this embodiment is formed as a No. 1 wood golf club head having a head volume of 400 $cm^3$.

In the golf club head 10 of this embodiment, the ratio of the rigidity of the sole portion 12 to that of the crown portion 14 is 1:0.4, and the rigidity of the sole portion 12 to that of the side portion 16 is 1:0.4

In the golf club head 10 according to this embodiment, the thicknesses of the sole portion 12, crown portion 14, side portion 16, and face member 22 are uniform, which are 1.3 mm, 0.6 mm, 0.6 mm, and 3 mm, respectively. Hence, the ratio of the average thickness of the sole portion 12 to that of the crown portion 14 is 1:0.46.

Figure 6:
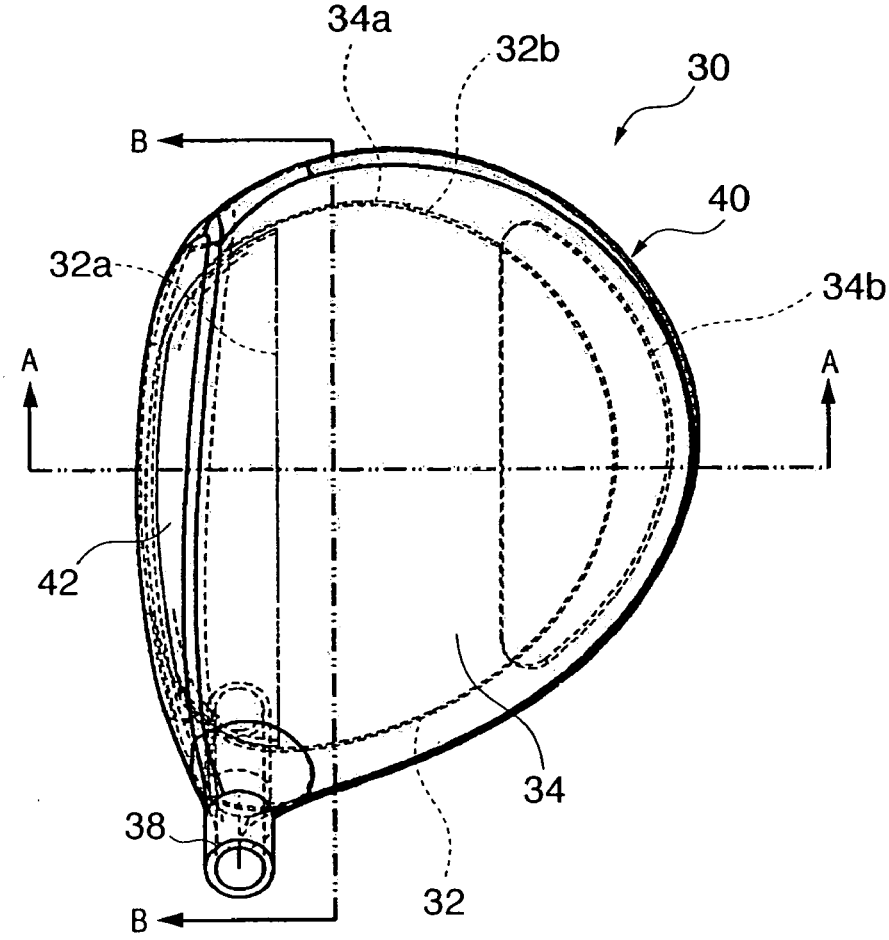
FIG. 6 is a plan view showing a golf club head according to another embodiment of the present invention.
Figure 7:
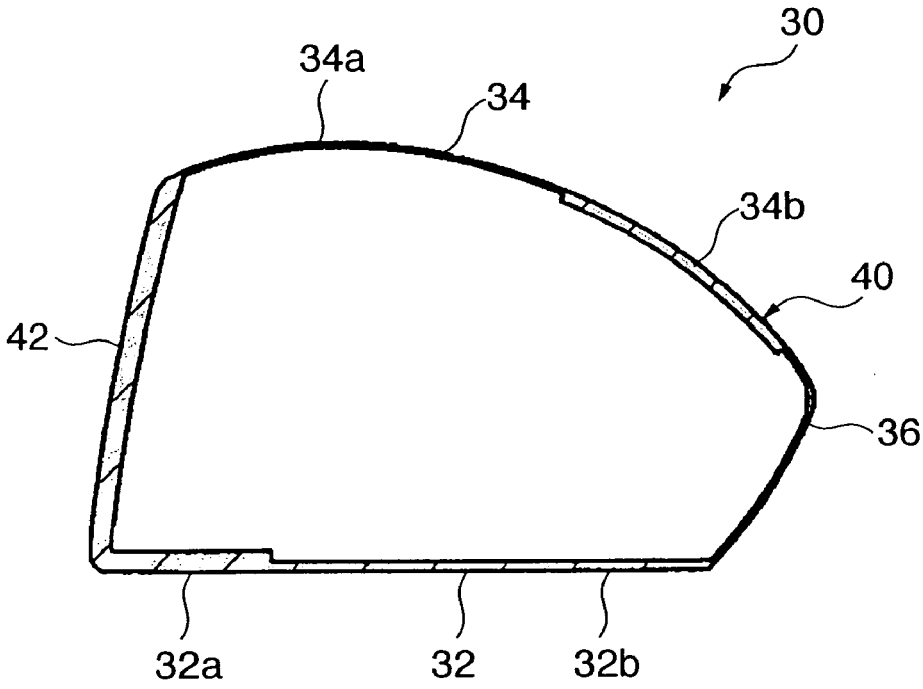
FIG. 7 is a sectional view taken along the line A-A of FIG. 6.
Figure 8:
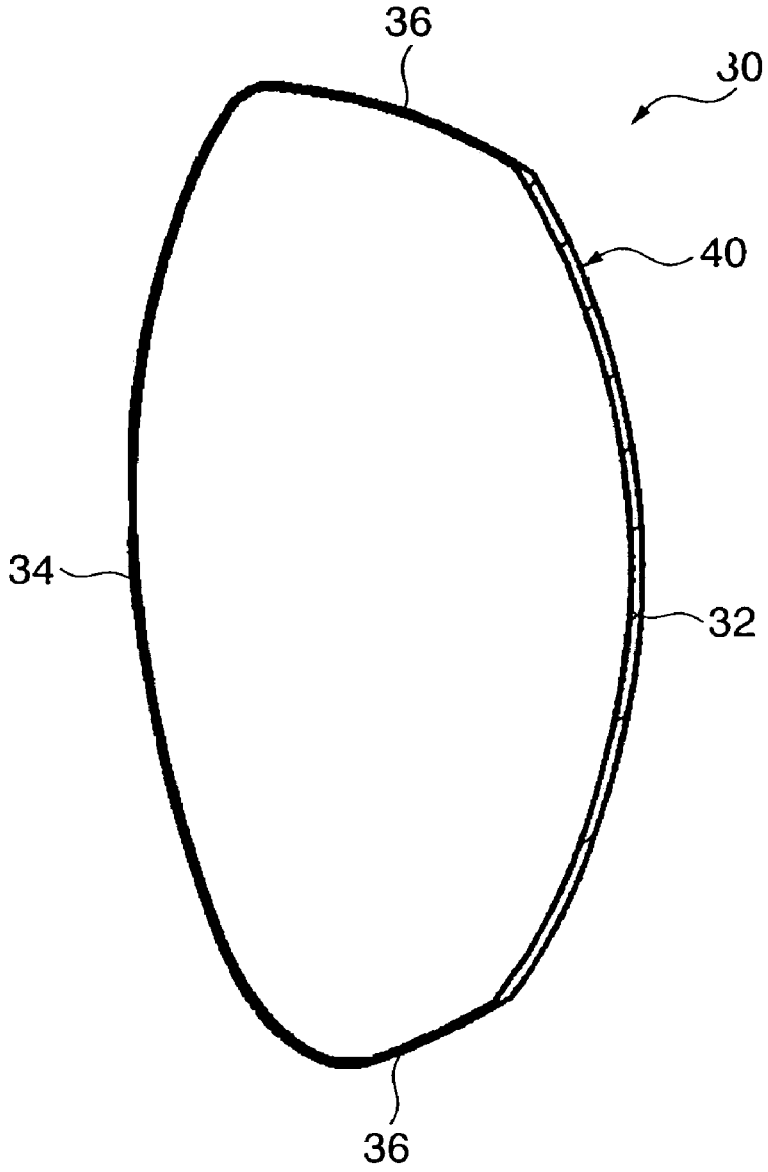
FIG. 8 is a sectional view taken along the line B-B of FIG. 6.

FIG. 6 is a plan view showing a golf club head according to another embodiment of the present invention, FIG. 7 is a sectional view of the golf club head taken along the line A-A of FIG. 6, and FIG. 8 is a sectional view of the golf club head taken along the line B-B of FIG. 6.

A golf club head 30 according to this embodiment is obtained by fixing a face member 42 to the face opening of a head main body 40 having a sole portion 32, crown portion 34, side portion 36, and hosel portion 38 by plasma welding. The material of the head main body 40 is 6-4Ti and the material of the face member 42 is SP700. The golf club head of this embodiment is formed as a No. 1 wood golf club head having a head volume of 400 $cm^3$.

In the golf club head 30 according to this embodiment, the ratio of the rigidity of the sole portion 32 to that of the crown portion 34 is 1:0.3, and the ratio of the rigidity of the sole portion 32 to that of the side portion 36 is 1:0.2.

In the golf club head 30 according to this embodiment, a sole thick-walled region 32*a* having a thickness of 2.5 mm is formed on the face side of the sole portion 32, and a sole thin-walled region 32*b* having a thickness of 1.2 mm is formed on the back side of the sole portion 32. A crown thin-walled region 34*a* having a thickness of 0.6 mm is formed on the face side of the crown portion 34, and a crown thick-walled region 34*b* having a thickness of 1.5 mm is formed on the back side of the crown portion 34. The average thickness of the sole portion 32 is 1.7 mm, and that of the crown portion 34 is 0.9 mm. Hence, the ratio of the average thickness of the sole portion 32 to that of the crown portion 34 is 1:0.53. The thicknesses of the side portion 36 and face member 42 are uniform, which are 0.6 mm and 3 mm, respectively.

Figure 9:
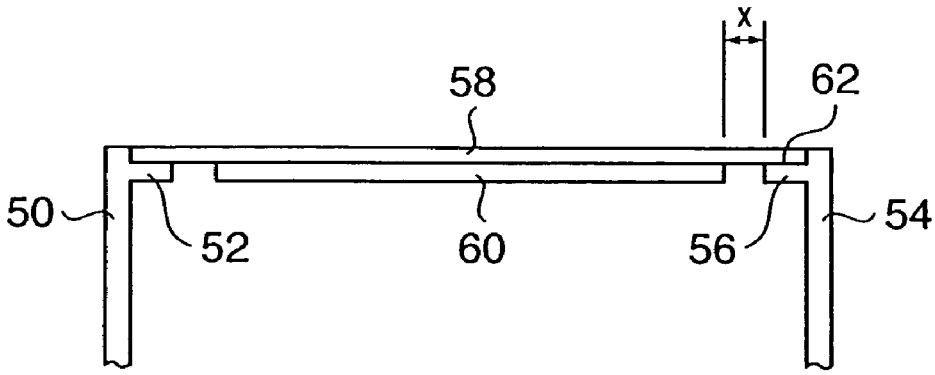
FIG. 9 is a schematic sectional view showing a crown portion provided with a vibration absorbing layer on its inner surface.
Figure 10:
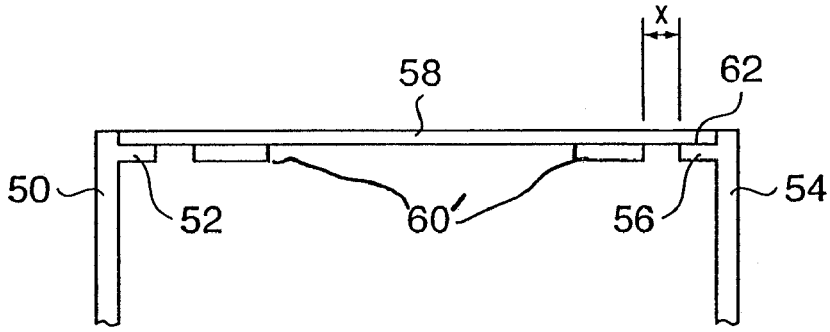
FIG. 10 is a schematic sectional view showing a crown portion provided with a vibration absorbing layer in the shape of a ring on its inner surface.

FIGS. 9 and 10 are schematic sectional views showing a crown portion provided with a vibration absorbing layer on an inner surface. In FIGS. 9 and 10, reference numeral 50 denotes a face portion, reference numeral 52 denotes an extended portion provided at the face portion 50, reference numeral 54 denotes a side portion, reference numeral 56 denotes an extended portion provided at the side portion 54, reference numeral 58 denotes a crown portion bonded to the extended portions 52 and 56 by welding, and reference numerals 60 and 60' denote a vibration absorbing layer composed of a viscoelastic material formed on the inner surface of the crown portion 58. The vibration absorbing layer 60 is in a plate shape covering a substantially entire surface of the crown portion 58. The distance between the vibration absorbing layer 60 and the welding spot 62 is 10 mm. The vibration absorbing layer 60' is in a ring shape covering an outer peripheral portion of the crown portion 58.

Examples will be shown hereinafter, but the present invention is not limited to the following examples. The golf club heads in which the average thicknesses of the face portion, the crown portion, the side portion and the sole portion have the values shown in Table 1 were produced. In this case, each of the golf club heads was produced by welding the head main body and the face member. The material of the head main body was 6-4 Ti, the material of the face member was SP 700, and the head volume was 400 $cm^3$.

The golf club was produced by using each of the golf club heads. The initial speed of a ball, the launch angle of a ball, the spin amount and the traveling distance were measured by test shots using the golf clubs. Here, the initial speed of a ball, the launch angle of a ball, the spin amount and the traveling distance were measured by using a measurement system "Science Eye" made by Bridgestone Sports Co., Ltd in which an image of a hit ball is captured by a CCD camera. The result is shown in Table 1.

TABLE 1

| | Reference product | Example 1 | Example 2 | Example 3 |
|---|---|---|---|---|
| Face portion average thickness (mm) | 3.0 | 3.0 | 3.0 | 3.0 |
| Crown portion average thickness (mm) | 1.0 | 0.6 | 0.6 | 0.3 |
| Side portion average thickness (mm) | 1.0 | 1.0 | 0.8 | 0.6 |
| Sole portion average thickness (mm) | 1.0 | 1.0 | 1.3 | 1.3 |
| Initial speed (m/s) | 61 | 61.5 | 61.7 | 61.4 |
| Launch angle (degree) | 11 | 11.8 | 12.1 | 12.8 |
| Backspin amount (rpm) | 2500 | 2800 | 2750 | 3200 |
| Traveling distance (yard) | 230 | 233 | 240 | 230 |

The sensory evaluation of the hitting feeling of each of the golf clubs was performed by low handicap golfers. The result was as follows.

Reference product: firm and rigid feeling Example 1: normal, repulsion feeling.

Example 2: considerably soft, a little vibration remains.

Example 3: too light hitting feeling, and bad sound (too much sounding).

Further, golf club heads in which the vibration absorbing layers of a thickness of 1 mm formed of butyl bromide rubber were formed on the inner surfaces of the crown portions of the respective golf club heads were produced, and the golf clubs using these golf club heads were produced. The sensory evaluation of the hitting feeling of these golf clubs was performed low handicap golfers. The result is as follows.

Reference product (with vibration absorbing layer): no difference in hitting feeling, but the sound was low and muffled.

Example 1 (with the vibration absorbing layer): repulsion feeling, good.

Example 2 (with the vibration absorbing layer): becomes remarkably good, vibration is suppressed and firm feeling remains in hitting feeling.

Example 3 (with the vibration absorbing layer): the sound becomes slightly good, but vibration still remains, and hitting feeling is unfavorable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2005-241747, filed on Aug. 23, 2005, and No. 2006-112343, filed on Apr. 14, 2006 which are hereby incorporated by reference herein in their entirety.

What is claimed is:

1. A hollow golf club head comprising:

a face portion;

a sole portion extending backward from a lower portion of said face portion to form a bottom portion of said golf club head;

a crown portion extending backward from an upper portion of said face portion to form an upper portion of said golf club head; and a vibration absorbing layer in a film form composed of an elastic body on an inner surface of said crown portion, wherein said sole portion and said crown portion are configured such that a ratio of a rigidity of said sole portion to a rigidity of said crown portion is 1:0.1 to 0.8, said vibration absorbing layer has a ring shape covering an outer peripheral portion of said crown portion, said crown portion includes a thin-walled region formed on a face side of said crown portion and a thick-walled region formed on a back side of said crown portion, and said sole portion includes a thin-walled region formed on a back side of said sole portion and a thick-walled region formed on a face side of said sole portion.

2. The golf club head according to claim 1, further comprising a side portion, wherein said sole portion and said side portion are configured such that a ratio of the rigidity of said sole portion to a rigidity of said side portion is 1:0.1 to 0.8.

3. The golf club head according to claim 2, wherein said sole portion and said crown portion are configured such that the ratio of the rigidity of said sole portion to the rigidity of said crown portion is 1:0.4, and the ratio of the rigidity of said sole portion to the ratio of the rigidity of said side portion is 1:0.4.

4. The golf club head according to claim 2, wherein said sole portion and said crown portion are configured such that the ratio of the rigidity of said sole portion to the rigidity of said crown portion is 1:0.3, and the ratio of the rigidity of said sole portion to the ratio of the rigidity of said side portion is 1:0.2.

5. The golf club head according to claim 1, wherein said sole portion and said crown portion are configured such that a ratio of an average thickness of said sole portion to an average thickness of said crown portion is 1:0.3 to 0.8.

6. The golf club head according to claim 1, wherein said sole portion and said crown portion are configured such that a ratio of Young's modulus of a material of said sole portion to Young's modulus of a material of said crown portion is 1:0.3 to 0.9.

7. The golf club head according to claim 1, wherein said vibration absorbing layer is configured such that thickness of said vibration absorbing layer is 0.1 to 1 mm.

8. The golf club head according to claim 1, wherein the elastic body is a viscoelastic body.

9. The golf club head according to claim 1, further comprising a side portion, wherein said sole portion and said side portion are configured such that a ratio of the rigidity of said sole portion to a rigidity of said side portion is 1:0.2 to 0.6.

10. The golf club head according to claim 1, wherein said sole portion and said crown portion are configured such that a ratio of an average thickness of said sole portion to an average thickness of said crown portion is 1:0.5 to 0.7.

11. The golf club head according to claim 1, wherein said sole portion and said crown portion are configured such that a ratio of Young's modulus of a material of said sole portion to Young's modulus of a material of said crown portion is 1:0.5 to 0.8.

12. The golf club head according to claim 1, wherein said vibration absorbing layer is configured such that thickness of said vibration absorbing layer is 0.3 to 0.8 mm.

* * * * *